US006367476B1

(12) United States Patent
Conn

(10) Patent No.: US 6,367,476 B1
(45) Date of Patent: Apr. 9, 2002

(54) MEDICAL CANOPY AND SUPPORT APPARATUS FOR CANOPY AND TUBES

(76) Inventor: Brenda Sue Conn, 11 Gates Mill Rd., Lawrenceville, GA (US) 30045

( * ) Notice: Subject to any disclaimer, the term of this patent is extended or adjusted under 35 U.S.C. 154(b) by 0 days.

(21) Appl. No.: 09/351,027

(22) Filed: Jul. 12, 1999

(51) Int. Cl.[7] ..... A61G 10/00

(52) U.S. Cl. ..... 128/205.26; 128/DIG. 26; 248/124.1; 248/125.8; 248/345; 135/121

(58) Field of Search ..... 604/174, 77, 79; 128/205.26, 200.24, 204.18, DIG. 26; 248/125.8, 124.1, 345, 102, 103, 105, 106; 135/87, 121; 52/27, 36.4; 5/414, 416; D21/253

(56) References Cited

U.S. PATENT DOCUMENTS

| | | | | | |
|---|---|---|---|---|---|
| 3,306,289 | A | * | 2/1967 | Cameto et al. | 128/205.26 |
| 3,530,515 | A | * | 9/1970 | Jacoby | 128/205.26 |
| 3,680,557 | A | * | 8/1972 | Doniguian | 128/205.26 |
| 3,710,791 | A | * | 1/1973 | Deaton | 128/205.26 |
| 4,221,211 | A | * | 9/1980 | Brasch | 128/205.26 |
| 4,321,917 | A | | 3/1982 | Campbell | |
| 4,377,161 | A | | 3/1983 | Whitt | |
| 4,465,255 | A | | 8/1984 | Hill | |
| 4,591,121 | A | | 5/1986 | Doyle | |
| 5,334,186 | A | | 8/1994 | Alexander | |
| 5,387,177 | A | | 2/1995 | Dunn | |

OTHER PUBLICATIONS

Pediatric Aerosol Tents, Catalog Ohmeda, File No. 611 07/01 Datex (No other information).

Brochure—Nova Health Systems, Inc. New Product Introduction—Halo Breathing Tube Support for Oscillator Sized Tubing (No other information).

* cited by examiner

*Primary Examiner*—Angela D. Sykes
*Assistant Examiner*—Jeremy Thissell
(74) *Attorney, Agent, or Firm*—Jason A. Bernstein; Berstein & Associates, P.C.

(57) ABSTRACT

A support stand formed from a generally flat sheet of rigid material and having a base member, a generally vertical tube support member extending from the base, and a generally C-shaped portion interposed between the tube support and the base, the tube support having a generally circular edge with a plurality of generally circular notches defined therein. A canopy support member is provided having a generally vertical member with an elongate adjustment member extending therefrom and slidingly and detachably coupled to the tube support, and having a generally horizontal member hingedly attached to the generally vertical member, the generally vertical member having an opening for receiving a tube therethrough, the generally vertical member having at least one stop and the generally horizontal member having at least one surface capable of being positioned in a face to face relationship with and supporting a portion of the surface. A generally transparent canopy is preferably provided draping over the canopy support to form a space thereunder, the canopy having at least one air inlet opening, at least one air outlet opening, and at least one access opening. The horizontal member preferably has a quadrilateral shape with an opening defined therein. Alternatively, the generally horizontal member may be formed by an elongate arm with at least one finger pivotally mounted thereto and/or the apparatus may be provided without the tube support.

27 Claims, 4 Drawing Sheets

MEDICAL CANOPY AND SUPPORT APPARATUS FOR CANOPY AND TUBES

FIELD OF THE INVENTION

The present invention relates generally to a support apparatus for a medical canopy and medical tubes, and more particularly, to such a support apparatus for use with an incubator/isolette bed and/or warming bed for a premature baby.

BACKGROUND OF THE INVENTION

Medical patients occasionally have the need for a generally transparent canopy positioned over them to provide a sterile environment to protect them from potentially infectious airborne agents and to provide a controlled environment with temperature, moisture, oxygen, and like conditions best suited for patient skin and respiratory system treatment, function, and support. Such canopies are especially common for use with premature babies and other persons in serious condition. In such uses, canopies may be flexible or rigid and are typically provided with two openings, one for accepting standard sized tubes for providing the heat, moisture, and/or oxygen as is needed in a given situation and another opening for the exhaust of carbon dioxide produced by the respiring patient.

There are several situations in which it is extremely beneficial for a premature infant to be placed in a controlled environment under such a canopy. Infants commonly suffer from respiratory inflammations and/or maladies such as a sore throat, croup, and the like. In such cases, moisture may be provided in cooled or heated air through tubing and into the space formed under the canopy as desired to treat a given condition.

Another situation where a canopy is commonly employed is to provide oxygen therapy to an infant where there is a need for upper or lower respiratory support. In this situation, oxygen rich air is provided through the tubing to obtain and maintain the desired level of oxygen content in the air under the canopy. This method of oxygen therapy is preferable to the common alternative of using a mask covering the infant's mouth and/or nose.

An additional common alternate is to provide nasal cannula inserted into the infant's nose. This therapy is problematic, however, in that it tends to dry the mucus membranes of the nose even when providing humidified air through the cannula.

The method of creating an oxygen rich airspace under a canopy is preferable to the two alternatives just described because no uncomfortable tubes or mask are needed. The disadvantage to the oxygen rich environment method, however, is that the oxygen level of the air under the canopy fluctuates whenever the canopy is removed and reinstalled, or even merely disturbed, causing potentially severe physical distress to the premature infant. Conventional canopies must be removed for many routine matters requiring access to the infant such as examinations, repositioning blankets, pacifiers, and other comfort measures, and for any emergency situation.

Additionally, very low birth weight infants often experience a high degree of insensible water loss and heat loss as they have difficulty generating and maintaining adequate body heat because of their extremely small size and underdeveloped bodily systems. In such cases, heat and moisture may be provided through the tubing into the space under the canopy to create and maintain the desired temperature and humidity levels. However, removing and reinstalling the canopy causes fluctuations in the temperature and humidity of the air therein which can be distressful to the infant, as is the case with fluctuations in the oxygen level.

It is a common practice to place an infant under a canopy with controlled heat and moisture therein and with cannula tubes inserted into the infant's lungs for oxygen therapy. Furthermore, there are other situations where infants and other medical patients commonly have tubes inserted into them, such as cannula tubes for draining fluids, intravenous tubes for supplying medication or nourishment directly into the blood, and the like. Such tubes are sometimes attached to a frame to secure the tubes in place and prevent entanglement and/or dislodgment caused by movement of the patient. It is therefore desirable in certain situations, particularly in the care of premature infants, to have available a flexible canopy support apparatus that also provides a tube support structure. While several known canopy support devices and several known tube support devices provide certain benefits, there remain a number of deficiencies in the art as discussed hereinbelow.

There are several known apparatus for supporting a drape over a medical patient. U.S. Pat. No. 3,530,515 to Jacoby provides a patient guard for use during surgery having an adjustable support loop for surgical protective sheeting and tubing. U.S. Pat. No. 4,377,112 to Whitt provides a surgical breathing apparatus having an adjustable support frame for surgical drapes and oxygen supply tubing. U.S. Pat. No. 4,321,917 to Campbell provides a surgical drape support and oxygen supply device having an adjustable support rod for a surgical drape and tubing. These apparatus are provided for use during surgery, generally on adults, and accordingly have specific mounting requirements for the supports and/or for attachment of oxygen lines or the like, and are not well-suited for use with a premature baby in an incubator bed or warming bed.

Also, there is a known pediatric aerosol tent provided by Ohmeda, Inc., providing a tent having access openings and supported by a tent support arm mounted on a stand. A cooling and moisture system is also provided and connected to the tent by tubing. This apparatus has several disadvantages with regards to use with premature infants. The tent support arm is stationary, such that for use with a warming bed, when the tent is moved away to one end of the tent support arm the arm can be an obstruction to doctor and/or nurses leaning over and attending to the infant. In practice, therefore, the entire apparatus is generally moved away to the side in order to access the infant. Additionally, the apparatus does not provide a support for cannula tubing. Furthermore, this apparatus is specifically designed for a large infant bed or crib for larger and more developed infants and is too large to use for newborn infants, as many may be very small, and which is especially disadvantageous for use in neonatal wards which may not be able to accommodate the larger beds. Because of the large size of the stand and support arm, the unit will not fit into and thus can not be used in conjunction with a conventional incubator or warming bed as used in neonatal wards. This lack of flexibility is a significant limitation to more widespread use of the apparatus.

There are also known tents, hoods, and canopies provided by Nova Health Systems, Inc., having rigid cuboidal shapes with built-in support frames. These framed canopies have several disadvantages. They provide a rigid frame with a fixed top and sides, generally having only one side that provides access to the infant. Because of the fixed sides, they are not adjustable and they provide only limited access to the infant when covered by the canopy. Because of the lack of adjustability of the rigid framed apparatus of Nova Health Systems, Inc., neonatal units generally must either stock a number of different sizes of the units to accommodate for small and large babies, or stock only one size which will then only cover a larger infants head and not its torso and lower body. Where units of multiple sizes are stocked, this disadvantage is compounded because these are single patient units discarded after being used by one infant, such that an entire new unit having a canopy and frame must be purchased for each infant instead of just a new canopy. Where only one size is stocked, the aforementioned disadvantage is compounded because the larger of these units do not fit easily inside conventional incubator beds, and the smaller of these units can not be used with many of the currently available tube supports commonly placed inside the canopy, as will be discussed in more detail hereinafter.

The aforementioned disadvantage of limited access to the infant results in difficulty in comforting, treating, and administering developmental care to the infant. It is becoming increasingly recognized by those experienced in the field that developmental care contributes significantly to the health and wellbeing of premature infants. Developmental care may include repositioning on a frequent basis the infant's arms, legs, head, and torso to conform to the natural position in the mother's womb. This is often accomplished by positioning developmental supports and aids such as blanket rolls and the like under or about the infant at specific positions to obtain the desired body position. It is generally acknowledged that such developmental care results in a more comfortable, more healthy, and more happy infant, with the consequence of a cost savings from such infants often being released from the hospital sooner and with few or no positional deformities. It is generally very difficult to administer such developmental care through only one end of the rigid cuboidal canopy of the apparatus provided by Nova Health Systems, Inc.

Moreover, such limited access to the infant results in a significant disadvantage in emergency situations, when an examination is conducted, or in routine situations where the rigid frame overly limits access and the canopy and frame must be repositioned or removed. In these instances, removing and reinstalling the canopy results in fluctuations in the otherwise controlled environment under the canopy thereby causing potentially severe distress to the infant as discussed hereinabove. Furthermore, when the canopy is removed, it must be placed somewhere, which is often on a chair or cabinet, and in emergency situations is sometimes the floor. This can result in cross-contamination of the canopy, raising the potential for serious infections in susceptible premature infants or requiring the frequent replacement of canopies thereby increasing costs.

With regards to supports for medical tubes inserted into patients, there are several known such apparatus. The apparatus provided by the U.S. patents to Jacoby, Whitt, and Campbell discussed heretofore all provide a surgical drape support that also supports tubes or has tubes integrally formed therein. These apparatus, however, are generally designed in size, shape, mounting, performance, and the like, for adults and for use in surgery. Furthermore, in the use of these apparatus, movement of the tubes causes movement of the drape support and vice versa.

Additionally, U.S. Pat. No. 5,387,177 to Dunn provides an adjustable pediatric incubator nest having a base and a pair of sidewalls with slits for securing tubes. U.S. Pat. No. 5,334,186 to Alexander provides a medical tubing and implement organizer having a tubing holder with generally cylindrical lateral bores for holding medical tubing, and a base with apertures to accommodate various medical implements and accessories. There is also a known halo tubing support provided by Nova Health Systems, Inc., having a base and a vertically adjustable circular or rectangular frame with tubing holder notches. These tube supports, however, generally have little adjustability and therefore can not be practically used with all canopies, thereby requiring buying and stocking tube support devices in multiple sizes. While these apparatus provide the benefit of being capable of use with many canopies and then the canopy removed when not needed, they do not themselves include a support means for a canopy.

Accordingly, what is needed but not found in the prior art is an apparatus for supporting and securing in place a flexible medical canopy and/or tubes for use with premature infants, the canopy support vertically adjustable and also detachable from the tube support, with the canopy and support allowing ready access to the infant without removing the canopy, and with the canopy and support being easily moved when necessary for full access to the infant such that the support is out of the way of the attendants and the canopy does not have to be placed to the side where it may become cross-contaminated.

SUMMARY OF THE INVENTION

Generally described, the present invention provides a support apparatus for a flexible medical canopy and tubes for use with an infant bed or the like, comprising a support stand having a generally flat base member and a generally vertical tube support member extending from the base member, the tube support member having an edge with a plurality of notches defined therein, and a canopy support member comprising a generally vertical member slidingly coupled to the tube support and a generally horizontal member hingedly attached to the generally vertical member. A canopy is preferably provided for draping over the canopy support, having access openings defined therein which provide access for attendants to reach into the canopy to comfort, reposition, and treat the infant, and typically having two openings for connecting tubes supplying oxygen, moisture and/or heat.

A first preferred embodiment of the present invention provides the support stand formed from a generally flat sheet of rigid material and having a generally C-shaped portion interposed between the tube support and the base. The tube support edge is in a spaced apart relationship with the base and defines generally a semicircle, triangle, quadrilateral, irregular shape, or combination thereof. The notches are generally semi-circular, and preferably at least one of the tube support notches has a larger radius than at least one other of the tube support notches.

The generally vertical member of the canopy support has an elongate adjustment member. Preferably, the elongate adjustment member has a slot defined longitudinally therein and the tube support has a slot defined therein, the slots having an overlapping portion in a longitudinally aligned relationship with each other permitting at least one fastener to be extended through the aligned slots. Alternatively, the elongate adjustment member has a releasable latch and the tube support has a generally vertical track with at least one catch surface, the track receiving the elongate adjustment member and the at least one catch surface operatively engaging the latch.

The vertical member has at least one first stop and the horizontal member has a bottom surface capable of being supported by the first stop such that the horizontal member may be supported in a generally horizontal first position above the base. The hinged mounting of the canopy support permits the horizontal member to be pivoted thereabout at least about 90 degrees. Preferably, the vertical member has at least one second stop and the horizontal member has a bottom surface capable of being supported by the second stop such that the horizontal member may be supported in a second position pivoted less than or equal to about 270 degrees from the first position. The horizontal member of the canopy support preferably has a quadrilateral shape with an opening defined therein.

A second preferred embodiment of the present invention provides the generally horizontal member of the canopy support comprising an elongate arm. At least one finger, and preferably two fingers, are pivotally mounted to the elongate arm to provide an adjustable wingspan for supporting different canopies of various sizes.

A third preferred embodiment of the present invention provides the canopy support if the first embodiment mounted onto a support stand that has an upright member similar to the tube support of the first embodiment. The upright member, however, is generally smaller and without notches for tubes.

Accordingly, it is an object of the present invention to provide an apparatus for supporting a medical canopy and medical tubes for use with an incubator bed, warming bed, or the like, with the canopy support detachable from the tube support so that the canopy support can be removed, folded, and stored in a compact space when only the tube support is needed, and with the canopy and tube supports vertically adjustable so that one apparatus can be used for most every application desired in a neonatal ward.

It is still another object to provide a canopy with generally sealable openings defined therein and an apparatus for supporting the canopy yet allowing access to the infant covered thereby such that doctors, nurses, and other attendants can reach through the openings into the canopy for comforting and developmental care of the infant without the necessity of removing the canopy and without significant interference in the environment under the canopy.

It is yet another object to provide the canopy and apparatus for supporting the canopy such that the support can be moved out of the way of attendants when the canopy must be removed, and such that the canopy continues to be carried by the moved support so that the canopy does not have to be detached from the support and placed to the side where it may become cross-contaminated.

It is a further object to provide the tube support arranged so that movement of the infant does not cause tension on the tubes and yet the tubes do not have so much slack as to become entangled.

These and other objects, features, and advantages of the present invention are discussed or apparent in the following detailed description of the invention, in conjunction with the accompanying drawings and the appended claims.

BRIEF DESCRIPTION OF THE DRAWINGS

The various features and advantages of the invention will be apparent from the attached drawings, in which like reference characters designate the same or similar parts throughout the figures, and in which.

DETAILED DESCRIPTION OF THE PREFERRED EMBODIMENTS

Figure 1:
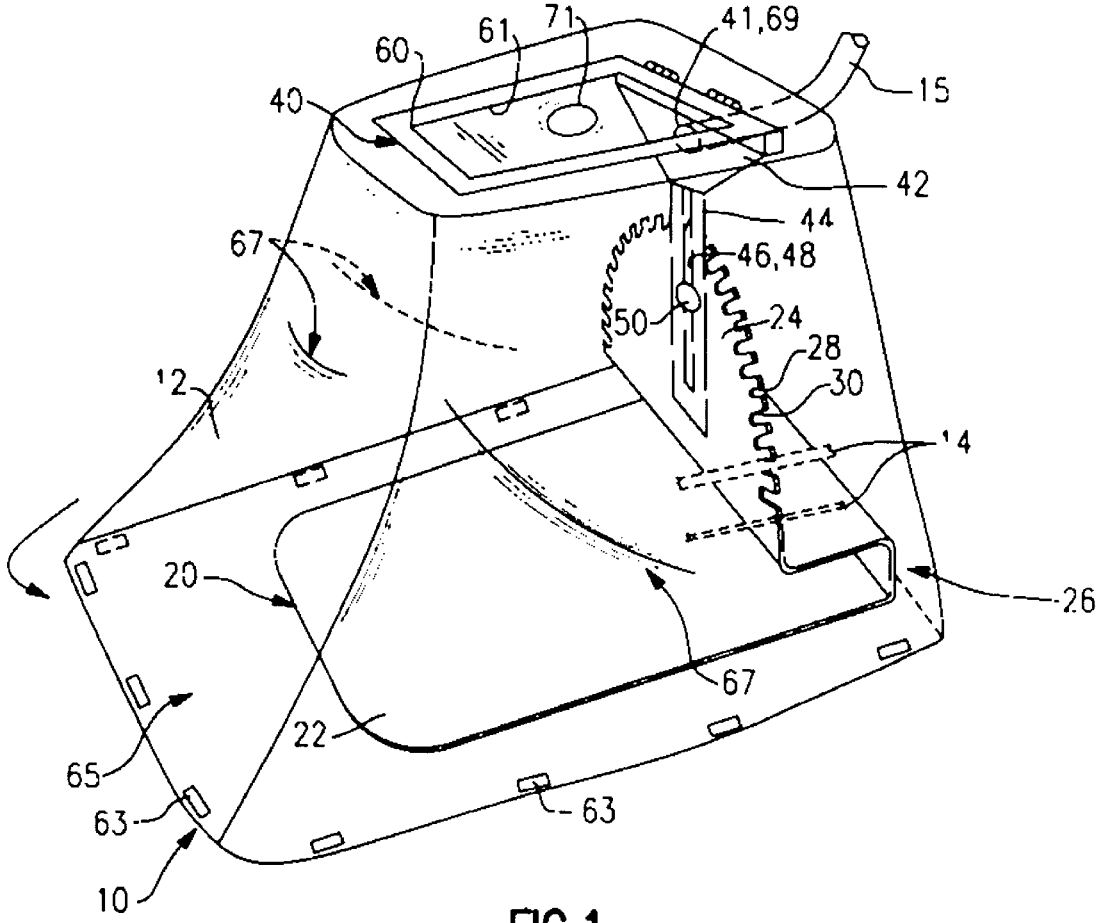
FIG. 1 is a perspective view of a first preferred embodiment of the present invention.
Figure 1A:
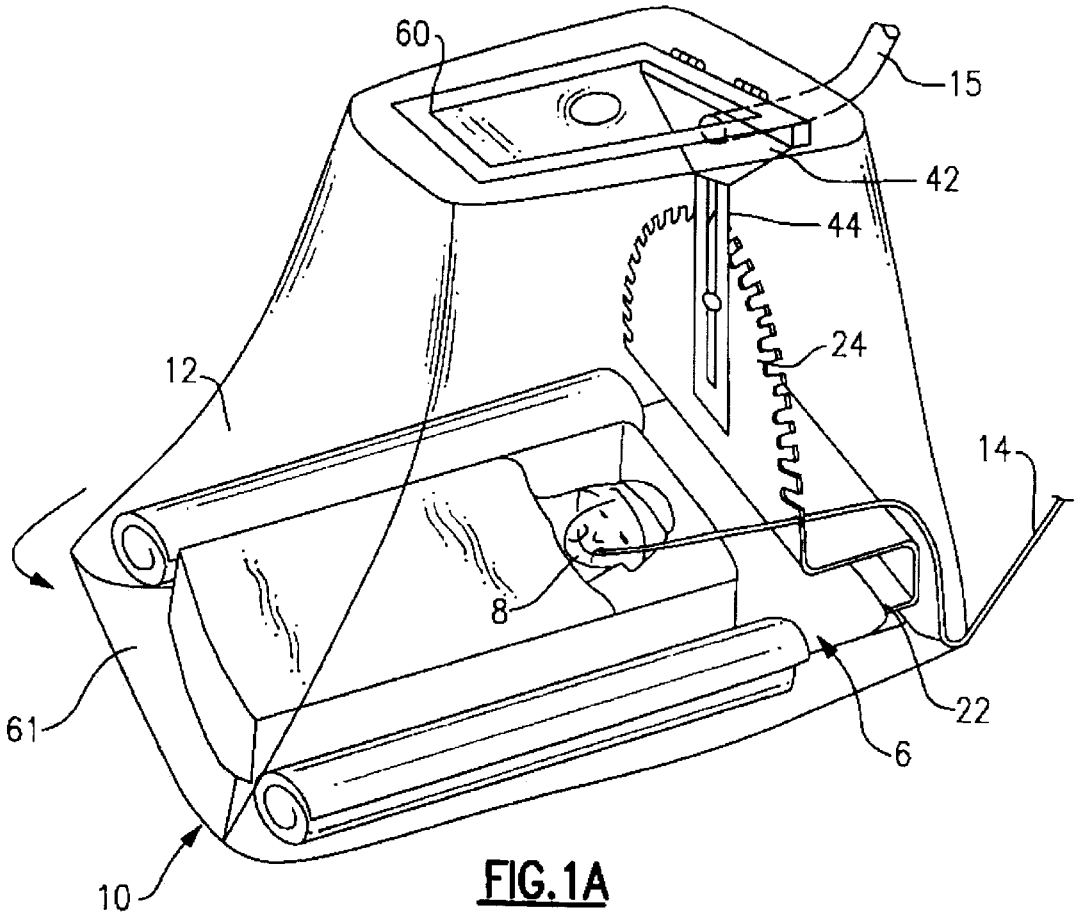
FIG. 1A is a perspective view of a first preferred embodiment of the present invention in use.

Referring now to FIGS. 1 and 1A, there is illustrated a first preferred embodiment of the present invention, providing a support apparatus 10 for a medical canopy 12 and tubes 14 and 15 for use with a conventional infant bed 6 or the like for a premature infant 8. Generally, the apparatus 10 is also suitable for applications including medical care and/or treatment of adults and particularly elderly and/or seriously ill persons, and also for applications involving animals, plants, artifacts and fine art, and/or any application where it is desirable to provide a sterile environment with controlled temperature, moisture, oxygen, and the like, and to also provide for visually monitoring and/or viewing the being or article within the environment.

The apparatus 10 is preferably made of a generally flat sheet of a rigid translucent or transparent material such as PLEXIGLAS® or a like thermoplastic resin. Optionally, the apparatus 10 may be made of an opaque material such as a metal, ceramic, composite, pigmented thermoplastic or the like. The support apparatus 10 may be fabricated by molding, stamping, or other techniques known to those skilled in the art.

A support stand 20 is provided having a base member 22 and a vertical tube support member 24 extending generally upward from the base 22. The base 22 is preferably sufficiently flat that it may be slid underneath the infant bed 6 to provide stability for the apparatus 10. A C-shaped portion 26 is preferably provided at an end of the base 22 from where the vertical tube support 24 upwardly extends. The C-shaped portion 26 may receive a portion of the infant bed 6 to provide for increased stability of the apparatus 10 by positioning the canopy support (described hereinafter) more centrally over the support stand 20.

The vertical tube support 24 preferably has an edge 28 with a plurality of notches 30 defined therein. The notches 30 are preferably generally semi-circular for receiving and securing in place medical tubes 14. Preferably at least one of the notches 30 is provided with a radius larger than a radius of at least one of the other notches 30, where the radii are selected based on the radii of conventional medical tubes 14 such as cannula tubes, intravenous tubes, oxygen tubes, and like medical tubes. The notches 30 are preferably positioned and spaced along substantially the entire edge 28 to provide maximum flexibility in tubing 14 position for various situations.

The edge 28 preferably defines generally a semicircle, providing a sufficient length for an adequate number of notches 30 and tubes 14 while also permitting maintenance of the tubes 14 in an spaced apart and organized arrangement to prevent tangling. Optionally, the edge 28 may define generally a triangle, a quadrilateral, a combination thereof, or other regular or irregular shapes. The edge 28 is maintained in a spaced apart position above the base 22 a sufficient distance to permit securing the tubes 14 in notches 30 a sufficient distance away from an infant 8 in the bed 6 to provide adequate slack in the tubes for prevention of pulling on and dislodgement of the tubes 14 when the infant 8 moves yet without causing kinks in and entanglement of the tubes.

The arrangement of the tube support 24 thereby provides for safely positioning and securing all medical tubes 14 on one of four sides of the infant bed 6, thereby maintaining the other three sides free of tubes 14 for permitting free access to and visibility of an infant 8 in the bed 6. Furthermore, the preferred use of transparent materials provides for maximum visibility of the infant 8 from the one side of the bed 6 where the tubes 14 are positioned.

A canopy support member 40 is provided having a generally vertical member 42 with an elongate adjustment member 44 capable of being slidingly coupled 45 to the vertical tube support 24. The generally vertical member 42 preferably has a generally circular opening 41 defined therein for receiving and securing a conventional tube that supplies air, oxygen, moisture, and/or heat.

Figure 4:
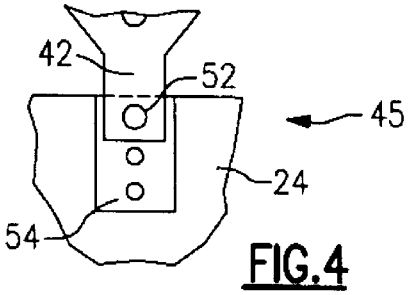
FIG. 4 is a front detail view of an alternate slide couple of the first preferred embodiment.
Figure 2:
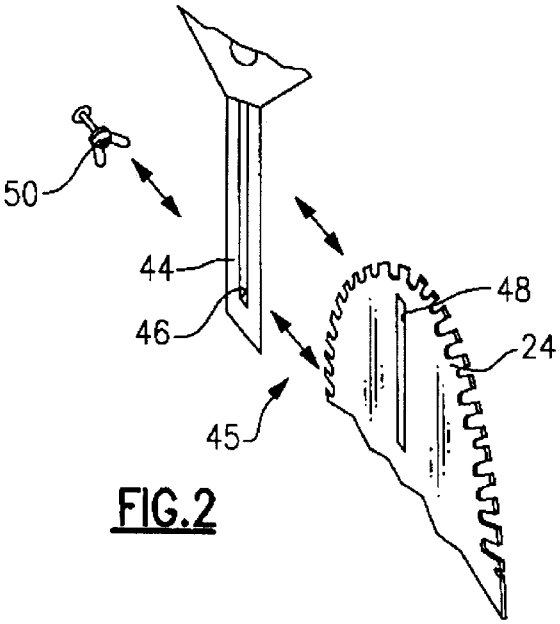
FIG. 2 is a perspective detail view of a slide couple of the first preferred embodiment.
Figure 3:
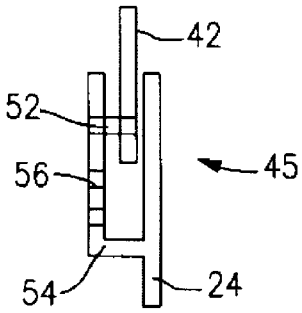
FIG. 3 is a side detail view of an alternate slide couple of the first preferred embodiment.

The slide couple 45 of the elongate adjustment member 44 provides for quickly and easily adjusting the height of the canopy support 40 as may be preferred in a given situation, and also preferably provides detachment of the canopy support 40 from the tube support member 24. The slide couple 45 is preferably comprised of a slot 46 defined in the elongate adjustment member 44 and a slot 48 defined the tube support, with the slots 46, 48 capable of at least partially overlapping and aligning to permit at least one fastener 50 being extending through said aligned slots 46, 48 (see FIG. 2). Optionally, the slide couple 45 may be provided by at least one spring-biased releasable latch 52 attached to the elongate adjustment member 44 which slides in a track attached to the tube support 24, with the latch operatively engaging at least one catch surface 56 defined in the track 54 (see FIGS. 3 and 4). Other slide couples 45 known to those skilled in the art, including couplings with snaps, clips, and the like, may be satisfactorily employed and should be selected for providing ease of vertical adjustment without compromising structural integrity. In some applications, it may be sufficient to provide the canopy support 40 attached to the tube support 24 without a slide couple 45.

The canopy support 40 has a generally horizontal member 60 hingedly attached to the generally vertical member 42. The generally horizontal member 60 preferably has a quadrilateral shape. Optionally, the generally horizontal member 60 may be provided in other regular or irregular shapes. The generally horizontal member 60 preferably has a central opening 12 defined therein to minimize weight, thereby forming a peripheral frame for supporting the canopy 12. Optionally, the generally horizontal member 60 may be provided as a solid body, a grill, a lattice, or the like.

The canopy 12 is may be provided independent of the other components of the apparatus 10 or provided therewith. The canopy 12 is preferably drapes over the canopy support 40 to form a space under the canopy 12 which can be then be regulated as to the amount of oxygen, humidity, heat, and the like in the air held therein. The canopy 12 is preferably made of a generally flexible thermal plastic or of a like material and is selected to provide sufficient insulation properties for a given situation. The canopy 12 may be provided in a generally circular, oval, rectilinear, or other regular or irregular shape. Preferably, the canopy 12 is generally flat, but may be molded and/or fitted with seams to have a form independent of the canopy support 40. The size of the canopy 12 is selected to cover the canopy support 40 at its highest vertical position and still provide an extra length 61 of canopy material for tucking under the infant bed 6, and is selected such that the infant 8 may be entirely covered or only partially covered (e.g., head only or head and torso) depending on the size and needs of the infant. It may be desirable to provide two or more sizes of the canopy 12 for maximum flexibility of use.

Figure 7:
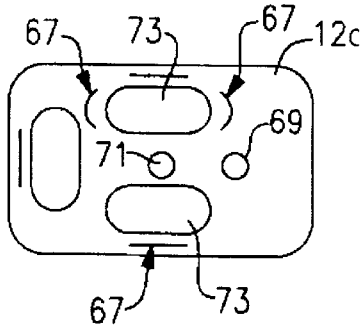
FIG. 7 is a detail view of an alternate canopy for use with either the first or second preferred embodiments.

Preferably, the canopy 12 is generally transparent to allow visual inspection by attendants of the infant 8 under the canopy 12. Optionally, as shown in FIG. 7, the canopy 12*a* may be provided of a generally opaque material having high thermal insulation properties as is known in the art, with the canopy 12*a* having at least one generally transparent portion 73 permitting visual inspection of the infant 8. The high insulation material is selected to maintain higher temperatures in the space formed under the canopy 12*a*. It is desirable for such a canopy 12*a* to have three or four transparent portions 73 arranged such that when the canopy 12*a* is positioned over the canopy support 40, the transparent portions 73 are positioned generally on sides of the apparatus 10 for visual inspection of the infant 8 from at least three sides. Such a canopy 12*a* may be used with the support apparatus 10 of the first, second, or third preferred embodiments as described herein.

Weights 63 may be provided formed into lower portions 65 of the canopy 12 to urge the lower portions 65 generally downward. The weights 63 are selected to be sufficiently heavy to urge the lower portions 65 generally downward sufficiently to assist in generally sealing the space under the canopy to prevent an undesirable intrusion of ambient air, and yet not so heavy as to cause undue deformation and potential failure of the canopy support 40.

At least one access opening 67, and preferably three openings 67, are preferably defined in the canopy 12 for providing access to the infant 8 by the attendants. The openings 67 are preferably arranged such that when the canopy 67 is draped over the canopy support 40, the openings 67 are positioned on the three sides other than the side with the tube support 24. The openings 67 may be provided as slits, holes, or the like, for sealing and may have zippers, snaps, or the like, or flaps having hook and loop fasteners, snaps, magnets, weights, or the like for covering the opening. The openings 67 are sufficiently large to permit an average person's hands and forearms to fit therethrough, yet not so large as to cause difficulty in generally sealing out ambient air when not being used to access the infant 8. An attendant may by use of the openings 67 reach into the space under the canopy 12 to comfort and administer developmental care techniques to the infant 8, without the need to remove the canopy 12 and thereby cause infant 8 distress due to the resulting fluctuations in the oxygen, heat, and humidity content of the air.

At least one air inlet opening 69 is preferably defined in the canopy for extending therethrough conventional tube 15 for supplying air, oxygen, moisture, heat, and the like into the space formed under the canopy 12. The opening 69 is generally circular to accommodate conventional circular tubing 15 as is commonly used is such applications. The opening 69 may be positioned in the canopy 12 to provide for axial alignment with the opening 41 in the vertical member 42.

At least one air outlet opening 71 is preferably provided in the canopy 12 for allowing the exhaust of carbon dioxide and the like from the canopy 12. The opening 71 is sized to be large enough provide sufficient outflow of air, but not so large as to permit the inflow of ambient air, in view of the positive pressure generally maintained within space formed under the canopy 12. The opening 71 is preferably arranged such that when the canopy 12 is draped over the canopy support 40, the opening 71 is positioned in the top side of the canopy 12.

Figure 6:
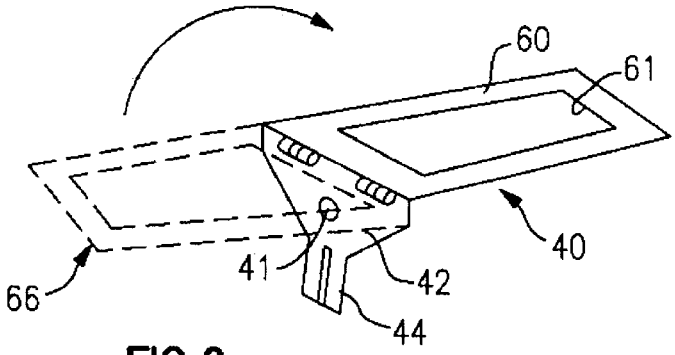
FIG. 6 is a perspective detail view of the canopy support of the first preferred embodiment.
Figure 5:
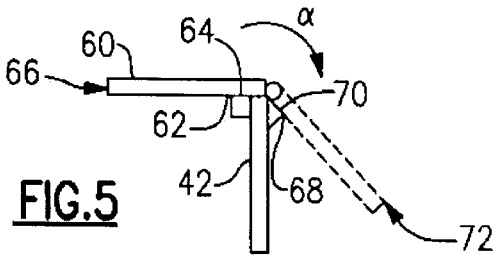
FIG. 5 is a side detail view of the hinged attachment of the canopy support member to the tube support member of the first preferred embodiment.

Referring now to FIGS. 5 and 6, the generally horizontal member 60 has a bottom surface 62 and a top surface 68. At least one first load-bearing stop 64 is provided, preferably associated with the generally vertical member 42. The bottom surface 62 has a portion capable of being supported by the stop 64 when the horizontal member 60 is pivoted into a generally horizontal first position 66 over the base 22.

Preferably, there is provided at least one second load-bearing stop 70 associated with the vertical member 42. The top surface 68 has a portion capable of being supported by the second stop 70 when the horizontal member 60 is pivoted to a second position 72 that is preferably pivoted between about 90 degrees and about 270 degrees from the first position 66. The second position 72 is preferably pivoted at least about 90 degrees so that the canopy support 40 can be pivoted up and over the tube support 24 for access to the infant 8 in the bed 6, but less than about 270 degrees so that the canopy support 40 does not interfere with the tubes 14 attached to the tube support 24. Optionally, the apparatus 10 may be provided without the second stop 70 so that the canopy support 40 may be folded flat for maximum compactness for storage such as in a drawer.

The stops 64, 70 are preferably provided by a bar having a surface capable of being positioned in a face to face relationship with the surfaces 62, 68 of the horizontal member. Optionally, the stops 64, 70 may be provided by triangular or curved protrusions extending from the horizontal member 60, by at least one pin or dowel extending generally horizontally through the vertical member 42, or by other support-type structures known to those skilled in the art. Optionally, the stops 64, 70 may be associated with the horizontal member and have a portion engaging and supported by sides of the vertical member 42.

Figure 8:
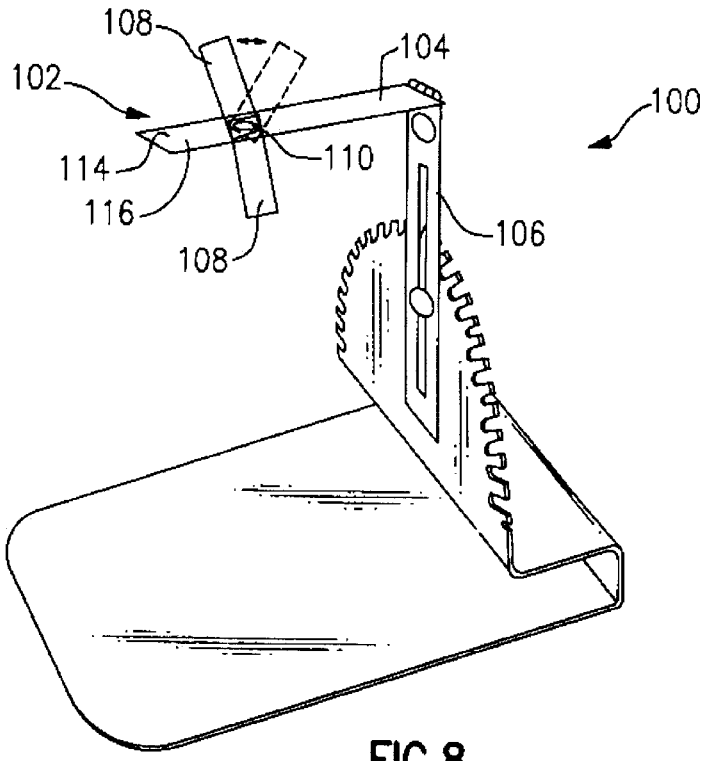
FIG. 8 is a perspective view of a second preferred embodiment of the present invention.

Referring now to FIG. 8, there is illustrated a second preferred embodiment 100 of a canopy support member 102 of the present invention. In the second embodiment, the canopy support 102 has a generally horizontal elongate arm 104 hingedly attached to a generally vertical member 106. The arm 104 is slidingly and detachably coupled to the vertical member 106 permitting interchangeability of the first embodiment horizontal member 60 and the second embodiment horizontal member 104.

The elongate arm 104 has at least one and preferably two fingers 108 pivotally mounted thereto such that the fingers 108 may be pivoted to any angle, and preferably to an angle of about 90 degrees from the elongate arm 104. The fingers 108 are preferably mounted to the elongate arm 104 by a pivotal coupling 110 such as a grommet, pin, rivet, or the like. The fingers 108 are preferably mounted on the elongate arm 104 at a position 112 some distance from an end 114 of the elongate arm 104 so that a portion 116 of the elongate arm beyond the fingers 108 provides a supporting function similar to the fingers 108. The fingers 108 are preferably attached to opposite (top and bottom) sides of the arm 104 to permit folding into a compact arrangement for storing in a drawer or the like. The fingers 108 thereby provide an adjustable wingspan for supporting different canopies in various sizes.

Figure 9:
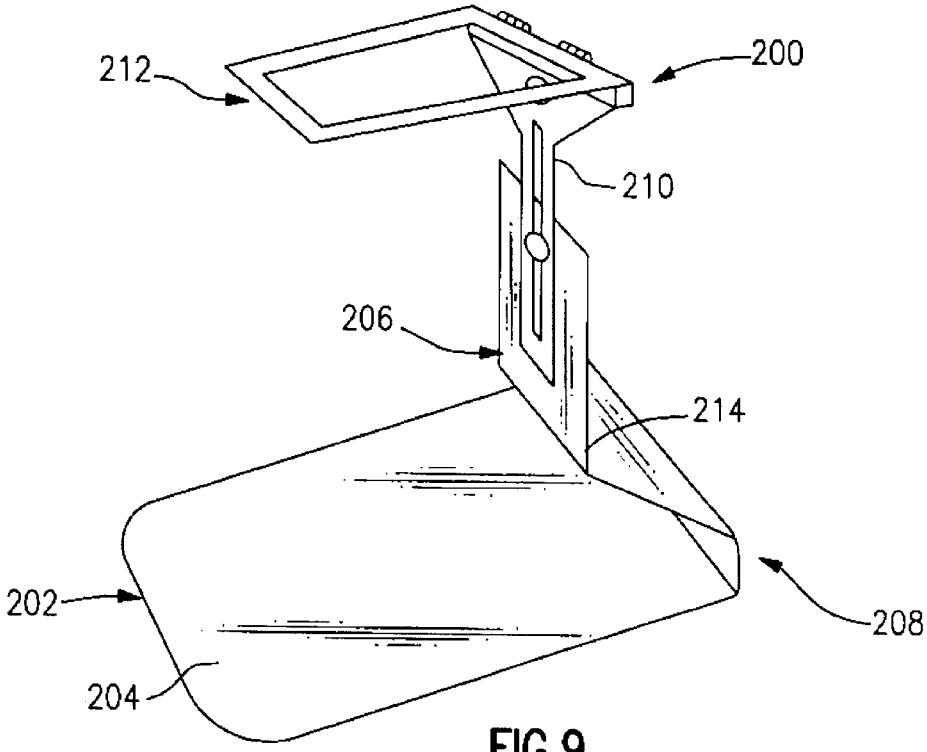
FIG. 9 is a perspective view of a third preferred embodiment of the present invention.

Referring now to FIG. 9, there is illustrated a third preferred embodiment 200 of the present invention comprising a support stand 202 having base member 204 and an upright member 206 extending generally upward from the base. A C-shaped portion 208 is preferably provided at an end of the base 204 from where the upright member 206 extends. The upright member 204 is slidingly and detachably coupled to a generally vertical member 210 of a generally horizontal canopy support 212. The upright member 206 is similar to the tube support 24 of the first embodiment, except the upright member 206 does not have notches 30 for tubes 14. The upright member 206 may thereby be provided with a smaller size relative to the tube support 24 to provide greater access to the infant under the canopy 12. The upright member 206 may thus be provided in any regular or irregular shape known to those skilled in the art, and may be provided generally flat and planar or with a curvature for angling generally over the infant bed 6. The C-shaped member 208 preferably has an angled portion 214 for transitioning from the upright member 206 to the C-shaped member 208. In the use of the apparatus 10 the canopy support 40 is pivoted back over the tube support 24 to the second position 72 so that an infant 8 may be laid in an infant bed 6 positioned on top of the base 22. Medical tubes may be inserted into the infant 8 and secured into the notches 30 in the tube support 24. The canopy support 40 is then pivoted back over the tube support 24 to the first position 66 and the canopy 12 placed over the canopy support 40. The canopy 12 is then tucked under the bed 6 to provide a generally sealed environment capable of oxygen, heat, and moisture control in the space formed under the canopy 12.

While under the canopy 12, the infant 8 may be visibly inspected through the generally transparent canopy 12. The infant 8 may receive further medical treatment and attention with the canopy 12 in place by reaching through the access openings 67 into the space under the canopy 12 without removing the canopy 12. Also, the infant 8 may be reached by lifting one side of the canopy for the desired access.

In cases where access to the infant 8 requires removal of the canopy 12, the front of the canopy 12 and horizontal member 60, 76 and the canopy 12 itself may be grasped together, and the horizontal member 60, 76 pivoted out of the way without having to entirely remove the canopy 12 and place it to the side. Because the canopy 12 does not have to be placed somewhere to the side, the risk of cross-contamination and thus infection is greatly reduced. The net result then is the increased comfort and wellbeing of the infant 8.

In situations where the infant's 12 condition improves and the canopy 12 is no longer required, the entire canopy support 40 may be readily detached from the stand 20, folded, and stored in a compact space such as a drawer. In the event the infant's 12 condition worsens and the controlled environment is again needed, the canopy support 40 may then be readily reattached and the canopy 12 draped anew over the canopy support 40. Unlike devices with rigid frames, the canopy 12 is removable from the canopy support 40 so that only the canopy 12 itself must be replaced for each new infant 8 for which the apparatus 10 is used, and the canopy support 40 and the tube support 20 are thus a one-time purchase item. This reusability feature provides an environmentally friendly apparatus 10 and reduces costs otherwise required for replacement components. The first embodiment 10 is advantageous for such uses as with larger infants who remain in medical care. The larger horizontal member 60 maintains a larger space under the canopy 12 to provide the necessary separation from the canopy 12 to the infant 8 to prevent undesired contact therebetween causing maceration of the infant's 12 skin. The larger horizontal member 60 also provides advantages for use with a warming bed 12 having radiant heat supplied typically from above.

The second embodiment 100 is advantageous for uses such as for smaller infants 12 and/or in conjunction with a conventional incubator where it is desirable to maintain higher temperature levels than could be maintained by either an incubator or canopy alone. The canopy support 102 of the second preferred embodiment 110 thus provides for adjustably configuring the elongate arm 104 and fingers 108 for supporting various sized canopies 12 and for covering different portions of the infant 8, such as the head only, the head and torso only, or the entire body.

The third embodiment 200 is advantageous for uses where medical tubes are generally not used. There is no support mechanism for medical tubes 14 which allows the upright member 206 to replace the tube support 24 thereby providing greater access to the infant 8 under the canopy 12. Tubes 14 may still be employed with this embodiment, however, they are not supported and secured in place by the apparatus 200.

Accordingly, there are a number of advantages provided by the present invention. Accordingly, an apparatus 10 is provided for use with an incubator bed 6, warming bed, or the like, having a canopy support 40 and a tube support 24 slidingly and detachably coupled together so that the canopy support 40 may be vertically adjusted relative to the tube support 24 or detached from the tube support 24 so that the tube support 24 may be used alone, so that one apparatus 10 can be used for most every application desired in a neonatal ward.

Also, the canopy support 40 is provided with a horizontal member 60 for stably supporting the canopy 12 over a large area to prevent the canopy 12 from contacting the infant's 12 skin and causing maceration thereof.

Furthermore, the apparatus 10 is provided with a generally transparent flexible canopy 12 with generally sealable openings 67 defined therein for allowing visual monitoring of and access to the infant 8 covered by the canopy 12 such that doctors, nurses, and other attendants can reach into the canopy 12 for comforting and developmental care of the infant 8 without the necessity of removing the canopy 12.

Additionally, the apparatus 10 is provided with a canopy support 40 having a horizontal member 60 that is hingedly attached to the vertical support member 42 so that the canopy 12 and canopy support 40 can be moved out of the way of attendants when the canopy 12 must be removed, such that the canopy 12 continues to be carried by the moved support 40 so that the canopy does not have to be detached from the support 40 and placed to the side where it may become cross-contaminated, and such that the canopy 12 and support 40 can be detached from the tube support 24 and the support 40 then folded and compactly stored in a drawer.

Moreover, the apparatus 10 is provided with the tube support 24 having a semi-circular edge 28 with notches 30 defined therein and spaced apart from the base 22 for supporting medical tubes 14 such that movement of the infant 8 does not cause tension in and dislodgement of the tubes 14 and yet the tubes 14 do not have so much slack as to become tangled.

Additionally, an apparatus 200 is provided having a canopy support 212 slidingly and detachably coupled to a base member 202 without a mechanism for supporting tubes, thereby providing the advantage of greater access to the infant 8 under the canopy 12.

While the invention has been described in connection with certain preferred embodiments, it is not intended to limit the scope of the invention to the particular forms set forth, but, on the contrary, it is intended to cover such alternatives, modifications, and equivalents as may be included within the true spirit and scope of the invention as defined by the appended claims. All patents, applications and publications referred to herein are hereby incorporated by reference in their entirety.

What is claimed is:

1. The support apparatus of claim 1, wherein said support stand has a generally C-shaped portion interposed between said tube support and said base.

2. The support apparatus of claim 1, wherein said tube support edge is in a spaced apart relationship with said base.

3. The support apparatus of claim 1, wherein said tube support edge defines generally a semicircle, triangle, quadrilateral, or combination thereof.

4. The support apparatus of claim 1, wherein said tube support notches are generally semi-circular.

5. The support apparatus of claim 4, wherein at least one of said tube support notches has a larger radius than at least one other of said tube support notches.

6. The support apparatus of claim 1, wherein said generally vertical member of said canopy support has an elongate adjustment member.

7. The support apparatus of claim 6, wherein said elongate adjustment member has a slot defined longitudinally therein and said tube support has a slot defined therein, said slots capable of overlappingand aligning, and further comprising at least one fastener capable of extending through said aligned slots.

8. The support apparatus of claim 3, wherein said generally horizontal member is formed by an elongate arm.

9. The support apparatus of claim 3, further comprising a canopy associated with said canopy support.

10. The support apparatus of claim 9, wherein said canopy has at least one air inlet opening defined therein and at least one air outlet opening defined therein.

11. The support apparatus of claim 9, wherein said canopy has at least one access opening defined therein.

12. A support apparatus for a canopy and tubes for use with a bed, comprising:

a) a support stand having a base member and a generally vertical tube support member extending from said base, said tube support having an edge with a plurality of notches defined therein; and, b) a canopy support member having a generally vertical member slidingly and detachably coupled to said tube support and a generally horizontal member hingedly attached to said generally vertical member, wherein said generally vertical member of said canopy support has an opening defined therein for receiving a tube.

13. A support apparatus for a canopy and tubes for use with a bed, comprising:

a) a support stand having a base member and a generally vertical tube support member extending from said base, said tube support having an edge with a plurality of notches defined therein; and, b) a canopy support member having a generally vertical member slidingly and detachably coupled to said tube support and a generally horizontal member hingedly attached to said generally vertical member, wherein said generally vertical member of said canopy support has an elongate adjustment member and wherein said elongate adjustment member has a releasable latch and said tube support has a generally vertical track and at least one catch surface, said track receiving said elongate adjustment member, said at least one catch surface operatively engaging said latch.

14. A support apparatus for a canopy and tubes for use with a bed, comprising:

a) a support stand having a base member and a generally vertical tube support member extending from said base, said tube support having an edge with a plurality of notches defined therein; and, b) a canopy support member having a generally vertical member slidingly and detachably coupled to said tube support and a generally horizontal member hingedly attached to said generally vertical member, wherein said generally vertical member has at least one first stop and said generally horizontal member has a bottom surface with a portion of said bottom surface capable of being supported by said first stop when said horizontal member is pivoted into a generally horizontal first position over said base, said hinged mounting permitting said horizontal member to be pivoted thereabout at least about 90 degrees.

15. A support apparatus for a canopy and tubes for use with a bed, comprising:

a) a support stand having a base member and a generally vertical tube support member extending from said base, said tube support having an edge with a plurality of notches defined therein; and, b) a canopy support member having a generally vertical member slidingly and detachably coupled to said tube support and a generally horizontal member hingedly attached to said generally vertical member, wherein said generally vertical member has at least one second stop and said horizontal member has a top surface with a portion of said top surface capable of being supported by said second stop when said horizontal member is pivoted into a generally horizontal second position pivoted less than 270 degrees from said first position.

16. A support apparatus for a canopy and tubes for use with a bed, comprising:

a) a support stand having a base member and a generally vertical tube support member extending from said base, said tube support having an edge with a plurality of notches defined therein; and, b) a canopy support member having a generally vertical member slidingly and detachably coupled to said tube support and a generally horizontal member hingedly attached to said generally vertical member, wherein said generally horizontal member has a quadrilateral shape.

17. The support apparatus of claim 16, wherein said generally horizontal quadrilateral member has an opening defined therein.

18. A support apparatus for a canopy and tubes for use with a bed, comprising:

a) a support stand having a base member and a generally vertical tube support member extending from said base, said tube support having an edge with a plurality of notches defined therein;

b) a canopy support member having a generally vertical member slidingly and detachably coupled to said tube support and a generally horizontal member hingedly attached to said generally vertical member, wherein said generally horizontal member is formed by an elongate arm; and, c) at least one finger pivotally mounted to said elongate arm.

19. A support apparatus for a canopy and tubes for use with a bed, comprising:

a) a support stand formed from a generally flat sheet of rigid material and having a base member, a generally vertical tube support member extending from said base, and a generally C-shaped portion interposed between said tube support and said base, said tube support having a generally circular edge with a plurality of generally circular notches defined therein;

b) a canopy support member having a generally vertical member with an elongate adjustment member extending therefrom and slidingly and detachably coupled to said tube support, and having a generally horizontal member hingedly attached to said generally vertical member, said generally vertical member having at least one opening defined therein for receiving a tube, said generally vertical member having at least one first stop and said generally horizontal member having at least one bottom surface capable of being positioned in a face to face relationship with and supporting a portion of said bottom surface; and c) a canopy associated with said canopy support, said canopy having at least one air inlet opening defined therein, and at least one air outlet opening defined therein, and at least one access opening defined therein.

20. The support apparatus of claim 19, wherein said generally horizontal member has a quadrilateral shape and an opening defined therein.

21. The support apparatus of claim 19, wherein said generally horizontal member is formed by an elongate arm with at least one finger pivotally mounted to said elongate arm.

22. The support apparatus of claim 19, wherein said canopy has at least one generally transparent portion.

23. A support apparatus for a canopy and tubes for use with a bed, comprising:

a) a support stand formed from a generally flat sheet of rigid material and having a base member, a generally upright member extending from said base, and a generally C-shaped portion interposed between said upright member and said base; and b) a canopy support member having a generally vertical member with an elongate adjustment member extending therefrom and slidingly and detachably coupled to said upright member, and having a generally horizontal member hingedly attached to said generally vertical member, said generally vertical member having at least one first stop and said generally horizontal member having at least one bottom surface capable of being positioned in a face to face relationship with and supporting a portion of said bottom surface.

24. The support apparatus of claim 23, further comprising a canopy associated with said canopy support, said canopy having at least one air inlet opening defined therein, at least one air outlet opening defined therein, and at least one access opening defined therein.

25. The support apparatus of claim 23, wherein said generally horizontal member has a quadrilateral shape and an opening defined therein.

26. The support apparatus of claim 23, wherein said generally horizontal member is formed by an elongate arm with at least one finger pivotally mounted to said elongate arm.

27. The support apparatus of claim 23, wherein said canopy has at least one generally transparent portion.

* * * * *